US007374519B2

(12) United States Patent
Naidus

(10) Patent No.: US 7,374,519 B2
(45) Date of Patent: May 20, 2008

(54) DYNAMICALLY CONTROLLED RESISTANCE EXERCISE MACHINE

(76) Inventor: Scott G. Naidus, 30 Schoolhouse Rd., Amherst, NH (US) 03031

( * ) Notice: Subject to any disclaimer, the term of this patent is extended or adjusted under 35 U.S.C. 154(b) by 549 days.

(21) Appl. No.: 11/038,039

(22) Filed: Jan. 21, 2005

(65) Prior Publication Data

US 2005/0164853 A1 Jul. 28, 2005

Related U.S. Application Data

(60) Provisional application No. 60/539,321, filed on Jan. 28, 2004.

(51) Int. Cl.
*A63B 21/00* (2006.01)
*A63B 21/08* (2006.01)

(52) U.S. Cl. ..... 482/137; 482/92; 482/97

(58) Field of Classification Search ..... 482/97, 482/100, 133, 136–139, 92, 114–118
See application file for complete search history.

(56) References Cited

U.S. PATENT DOCUMENTS 4,863,161 A * 9/1989 Telle ..... 482/97
5,088,726 A 2/1992 Lapcevie
5,387,170 A 2/1995 Rawls et al.
5,624,353 A * 4/1997 Naidus ..... 482/5
6,027,429 A 2/2000 Daniels
6,050,920 A 4/2000 Ehrenfried
6,074,328 A * 6/2000 Johnson ..... 482/97

* cited by examiner

*Primary Examiner*—Fenn C Mathew
(74) *Attorney, Agent, or Firm*—Richard C. Litman

(57) ABSTRACT

An exercise machine utilizing a dynamically controlled resistance technique. The machine employs two pivoting torque arms. Movement of a first torque arm is initiated by a user while performing an exercise routine. A strap and pulley system is utilized to guide a mobile member along the second torque arm to change the resistance perceived by the user. Weights can be added to the mobile member to further increase the perceived resistance. Hand levers are positioned to be operated by the user, which levers function to effect the movement of the mobile unit at any instant during the exercise routine.

15 Claims, 19 Drawing Sheets

DYNAMICALLY CONTROLLED RESISTANCE EXERCISE MACHINE

CROSS-REFERENCE TO RELATED APPLICATION

This application claims the benefit of U.S. Provisional Patent Application Ser. No. 60/539,321, filed Jan. 28, 2004.

BACKGROUND OF THE INVENTION

1. Field of the Invention

The present invention generally relates to exercise machines. More specifically, the present invention is drawn to a weight training machine utilizing two torque arms to vary perceived weight resistance without employing a motor or electronic means.

2. Description of the Related Art

In keeping with the fitness craze that has been part of the popular culture for the last decade or so, there has been a proliferation of new, exotic exercise machines. However, virtually all of today's conventional strength equipment is built with significant limitations that fall far short of delivering the means for physical challenges that would optimize the training effect sought by so many people in fitness today. Have you ever wondered what it would feel like to perform a set of 10 repetitions on a weightstack machine, where every repetition allows a maximum effort? That is the goal of high intensity training applied to weightstack machines. However, unless there are extraordinary measures taken by the user, it is impossible to achieve this goal in any practical way, on conventional weightstack machines. Thus, conventional machines require greater time and result in wasted (or inefficiently applied) energy for the serious user.

No matter what group a person is in (the basic maintain-and-stay-fit-group or the eat-sleep-dream-breath-iron-pro-bodybuilder group) there has been both a scientific and pragmatic realization that a fundamental shift to higher-intensity, shorter-duration strength training is the smarter, more economical and more efficient way to exercise. Examples of related art, as cited in the accompanying IDS, disclose conventional systems that utilize electric motors to achieve desired results when performing exercise routines. Also disclosed are systems that employ torque cams, and variable resistance. However, none of the above inventions and patents, taken either singly or in combination, is seen to disclose an exercise machine employing a dynamically controlled resistance technique as will be subsequently described and claimed in the instant invention.

SUMMARY OF THE INVENTION

The present invention is drawn to an exercise machine utilizing a dynamically controlled resistance technique (DCR) The preferred embodiment of the machine employs two pivoting torque arms. Movement of a first torque arm is initiated by a user while performing an exercise routine. It should be pointed out that the first torque arm could be replaced by a clutch mechanism or the like. A strap and pulley system is utilized to guide a mobile member along the second torque arm to change the resistance perceived by the user. As contemplated, weights can be added to the mobile member to further increase the perceived resistance. Hand levers are operated by the user, which levers function to effect the movement of the mobile unit at any instant during the exercise routine.

The present invention provides for improved elements and arrangements thereof for the purposes described which are inexpensive, dependable and fully effective in accomplishing their intended purposes.

A clear understanding of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
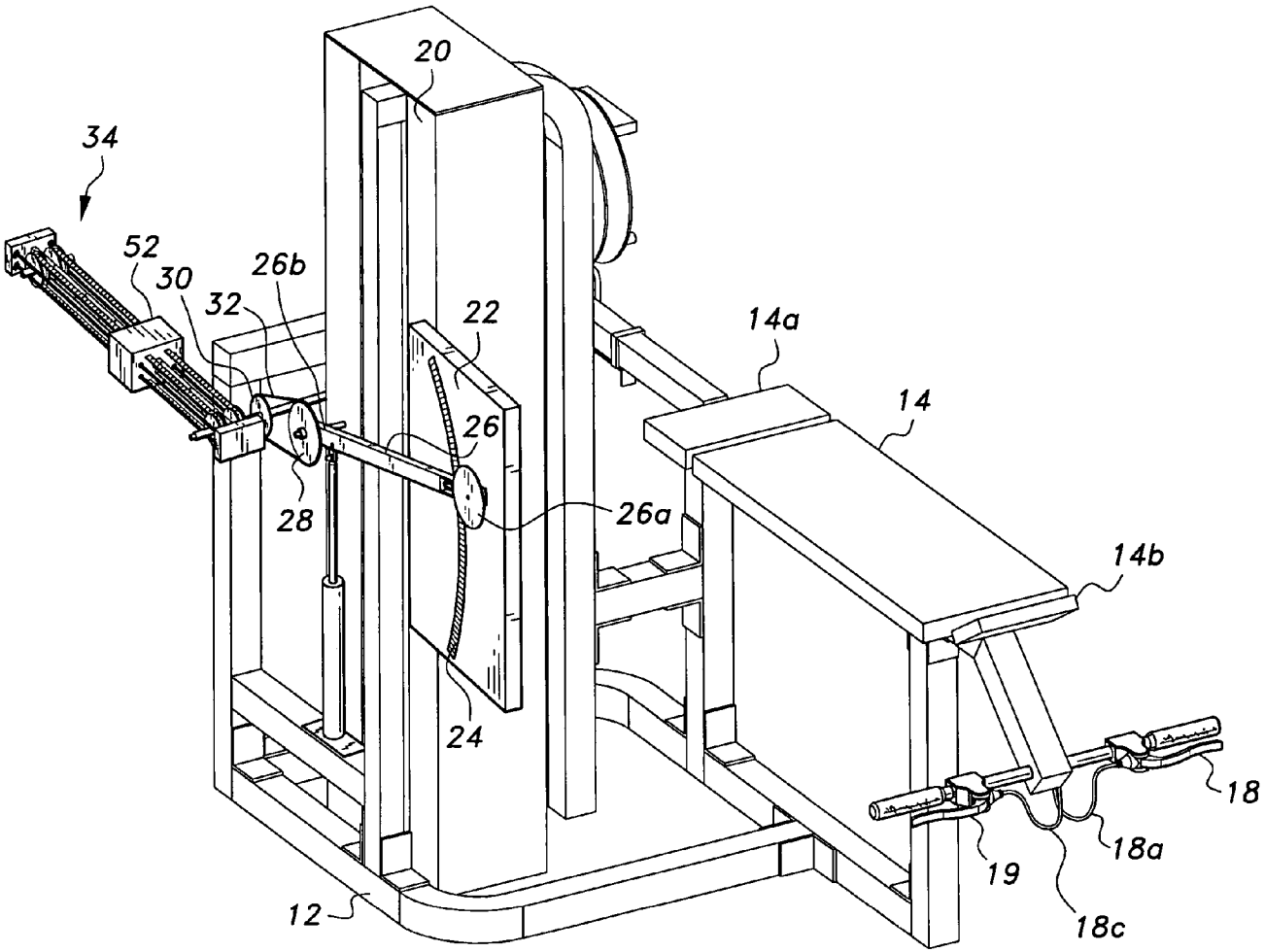
FIG. 1 is an environmental, perspective view of an (DCR) exercise machine with torque arms according to the present invention.

Attention is first directed to FIG. 1 wherein an exercise machine incorporating the present invention is generally illustrated. A frame 12 supports a bench 14 thereon. Bench 14 permits a user to lie in prone position with the user's legs extended beyond the rear end 14*a* of bench 14 to engage a conventional exercise arm. A pair of control levers 18 (positive), 19 (negative) is supported from the front end 14*b* of the bench. Control lines 18*a*, 18*c* whose purpose will be later explained, extend from respective levers 18, 19. A housing 20 is mounted on frame 12 and extends upwardly therefrom. A board 22 is attached to an exterior surface of the housing. Board 22 has an exterior face with an arc-shaped gear track 24 disposed thereon. A first end 26*a* of a first torque arm 26 is adapted to slidably move along said gear track. A second end 26*b* of torque arm 26 is pivotally attached to housing 20. A first sprocket 28 is attached for rotary movement at end 26*b*. A second sprocket 30 is linked by sprocket chain 32 to sprocket 28. A second torque arm 34 is coaxially mounted with sprocket 30 for pivoting movement. A mobile unit 52 is mounted for sliding movement on second torque arm 34. As will be subsequently explained below, the interaction of the above parts function to allow the user to instantly change perceived resistance at any time during the exercise routine.

Figure 2A:
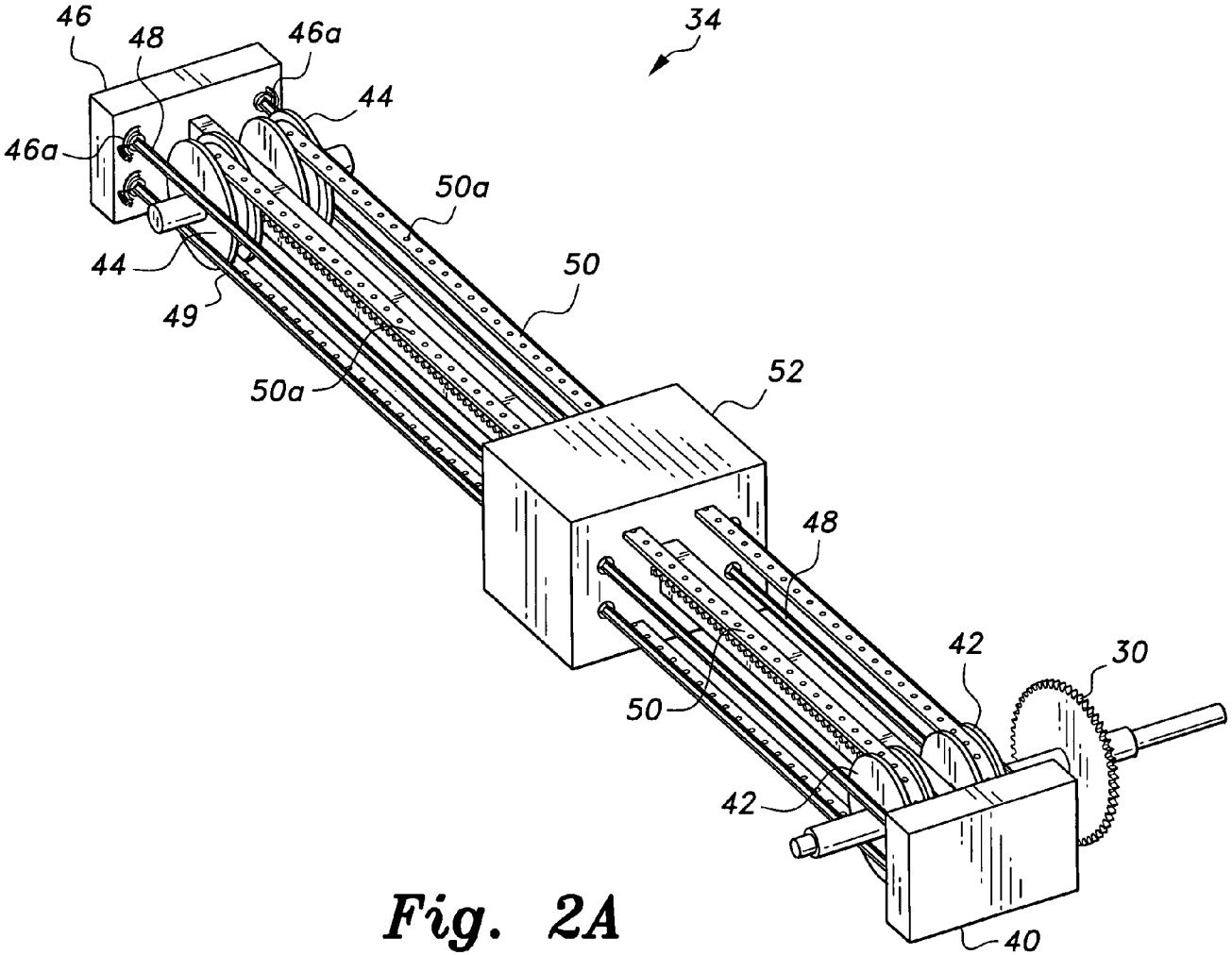
FIG. 2A is a perspective view of pivoting, resistance varying, torque arm according to the present invention.
Figure 2B:
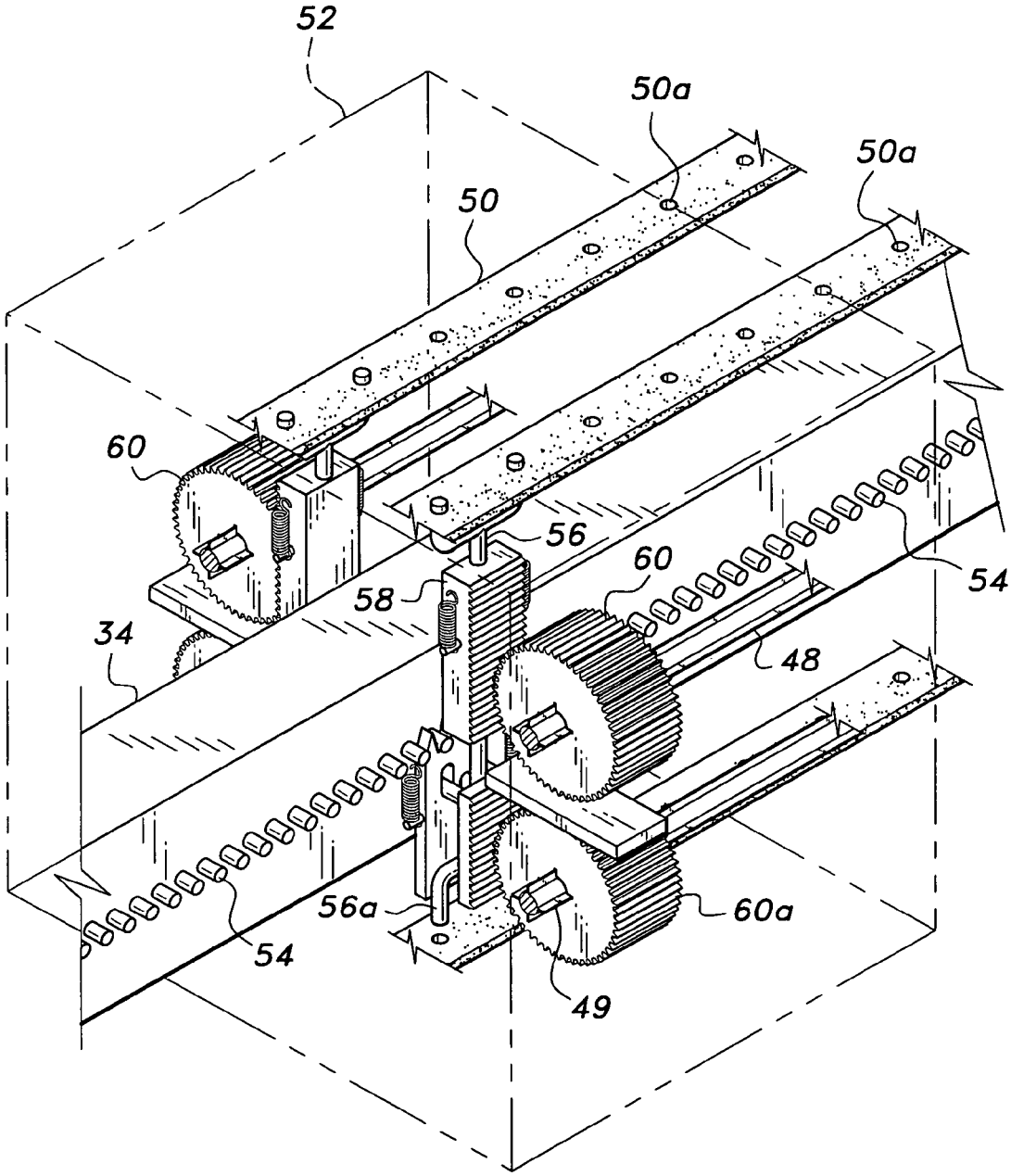
FIGS. 2B-2H are cut-away views illustrating the mechanisms housed in the mobile unit according to the present invention.
Figure 2C:
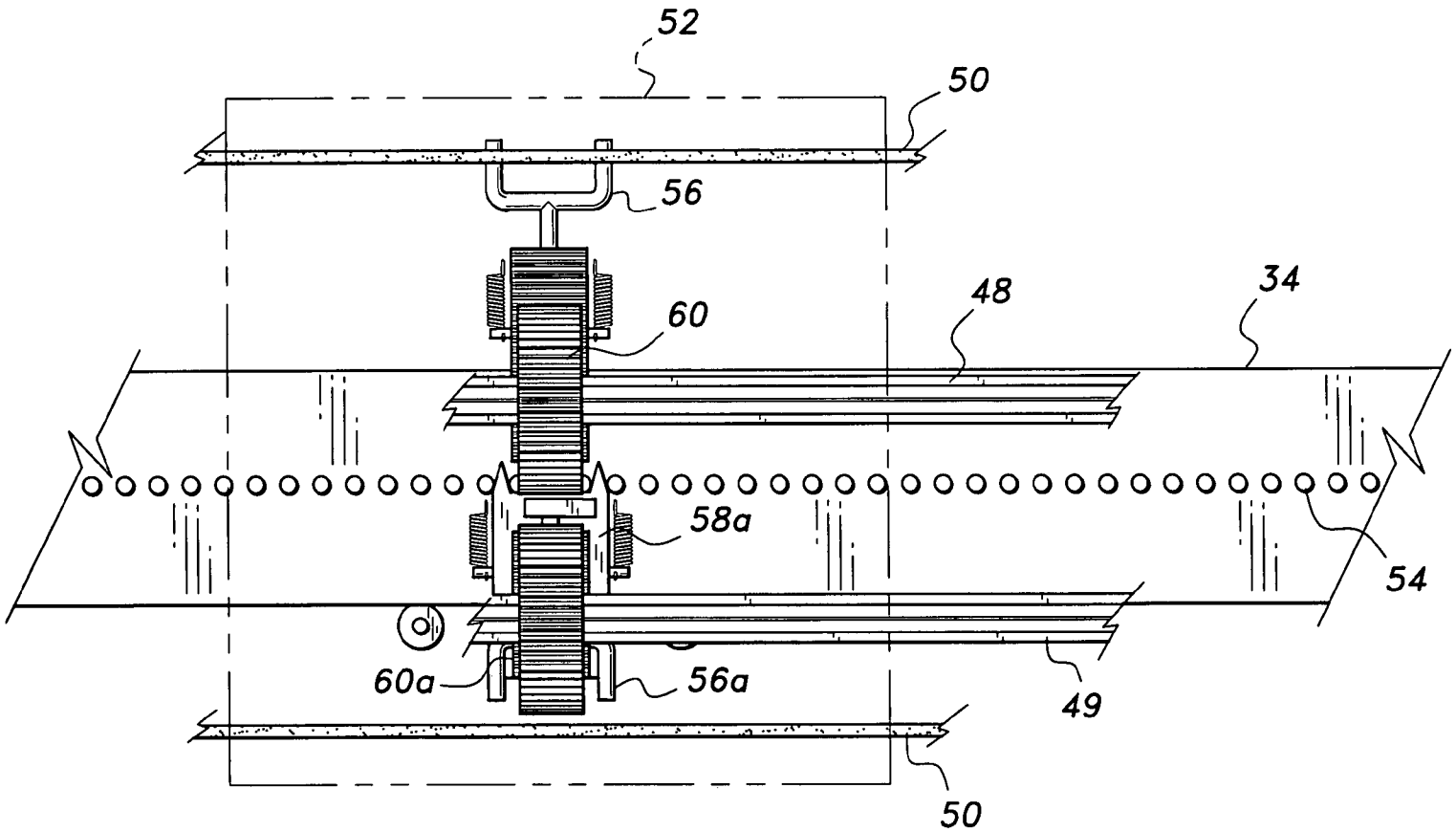
Figure 2D:
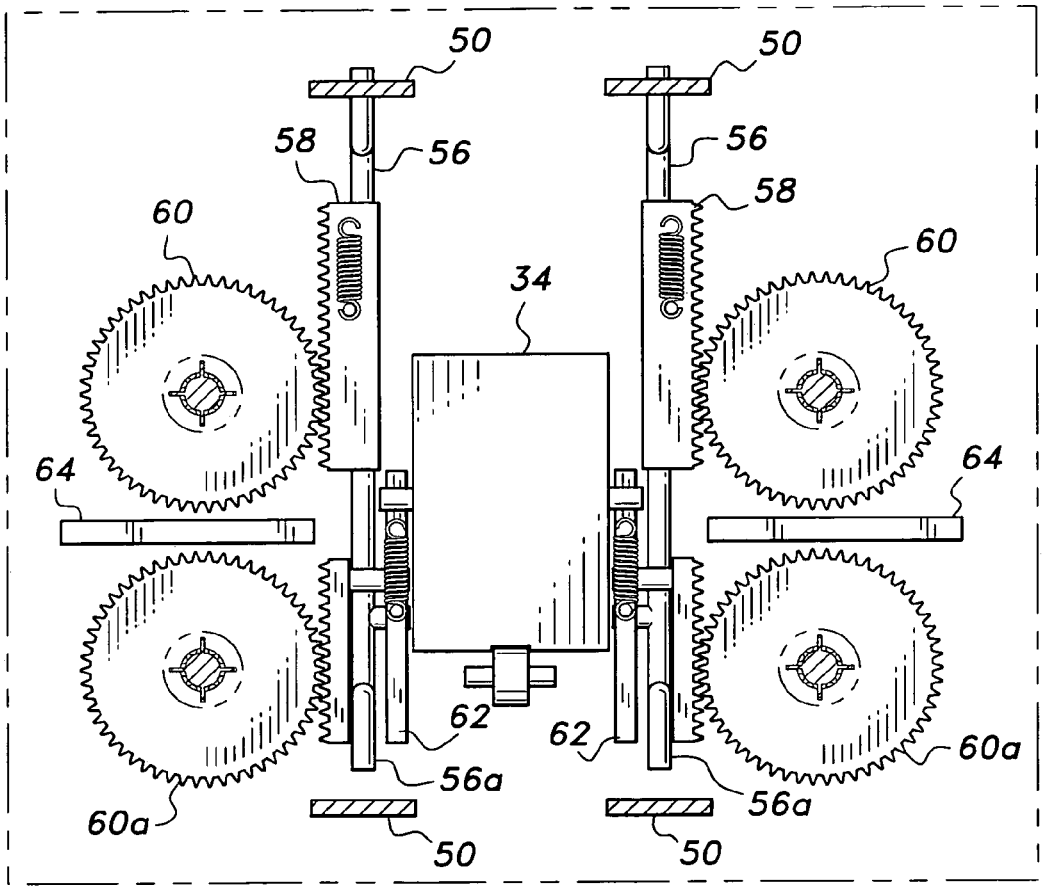
Figure 2E:
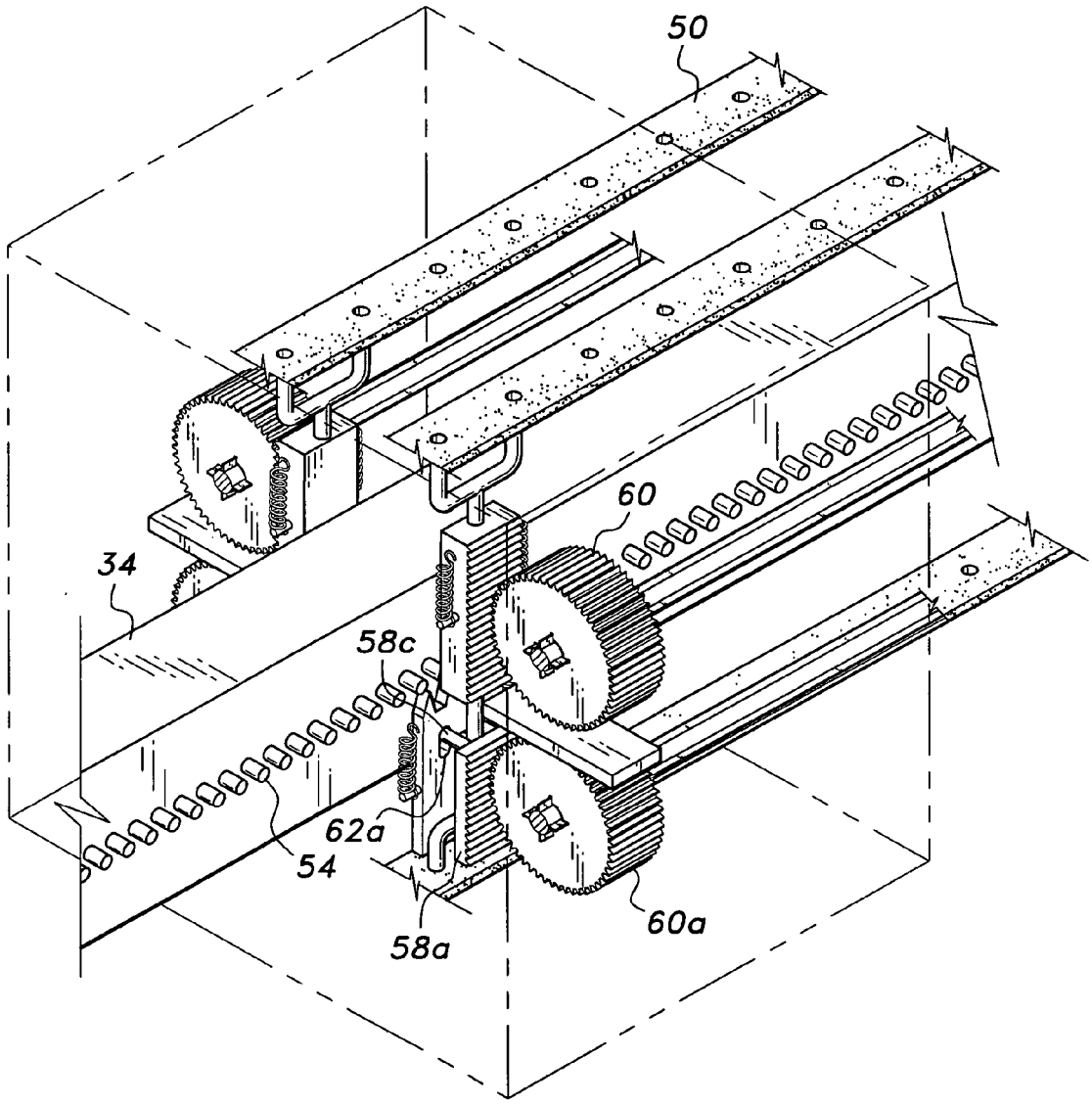
Figure 2F:
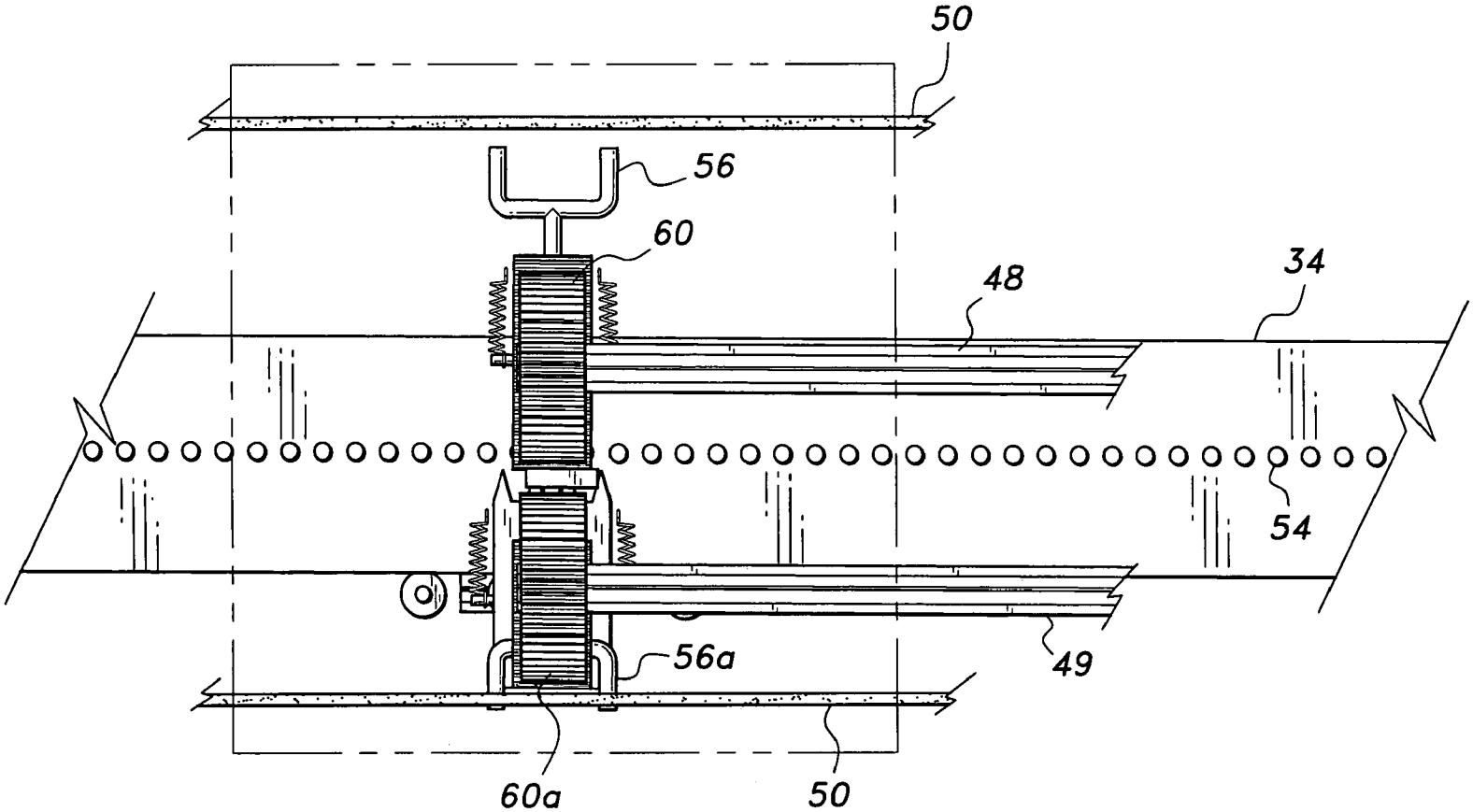
Figure 2G:
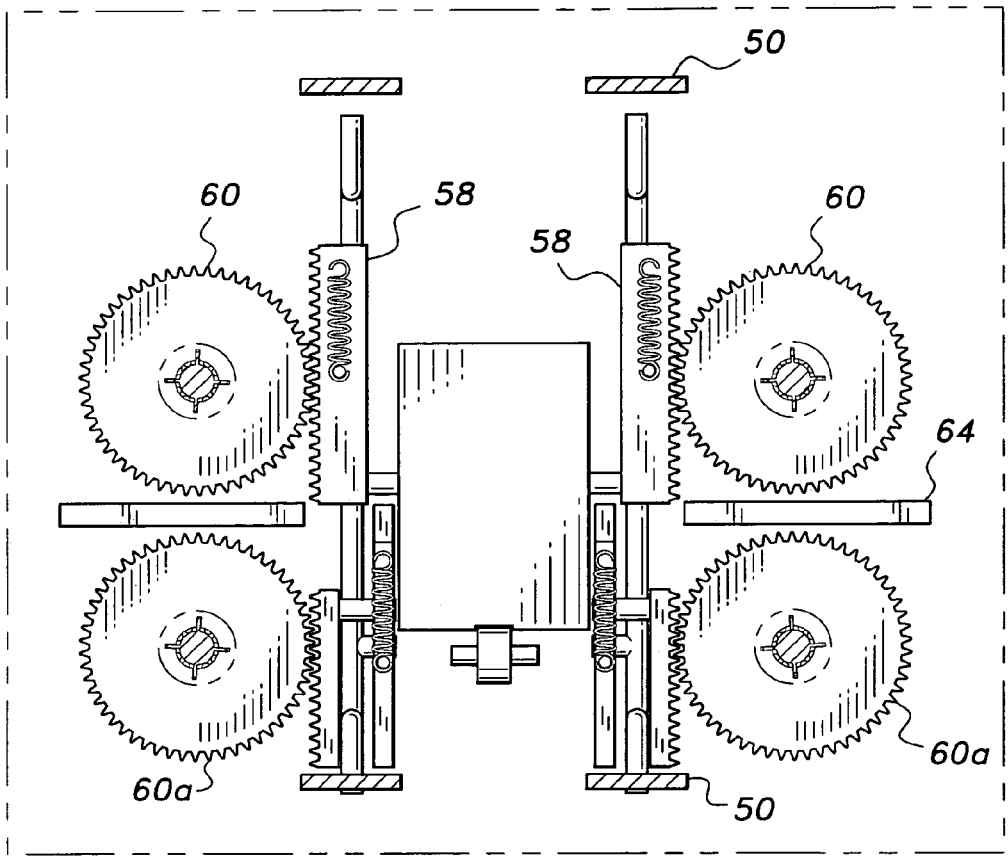
Figure 2H:
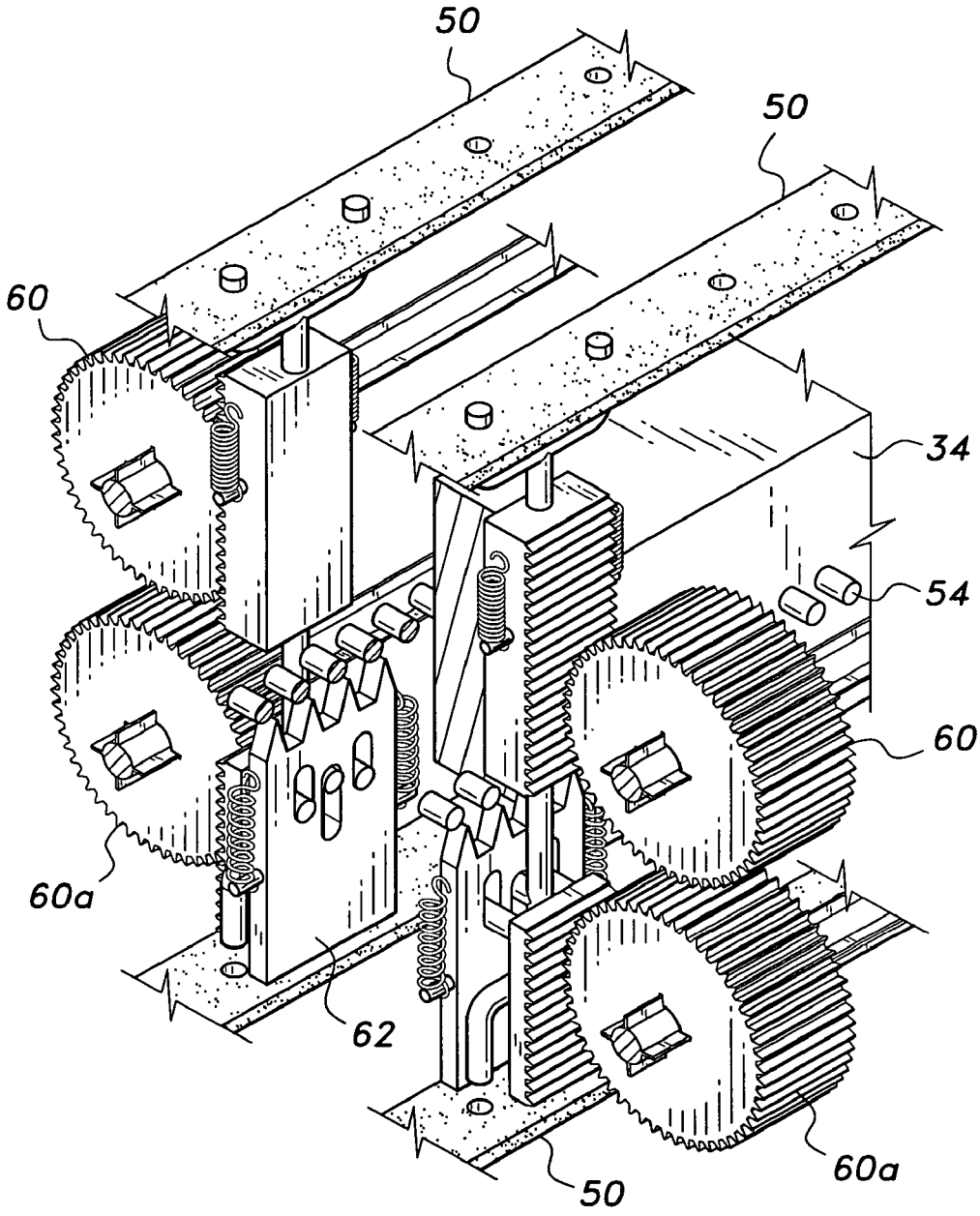
Figures 3A, 3B:
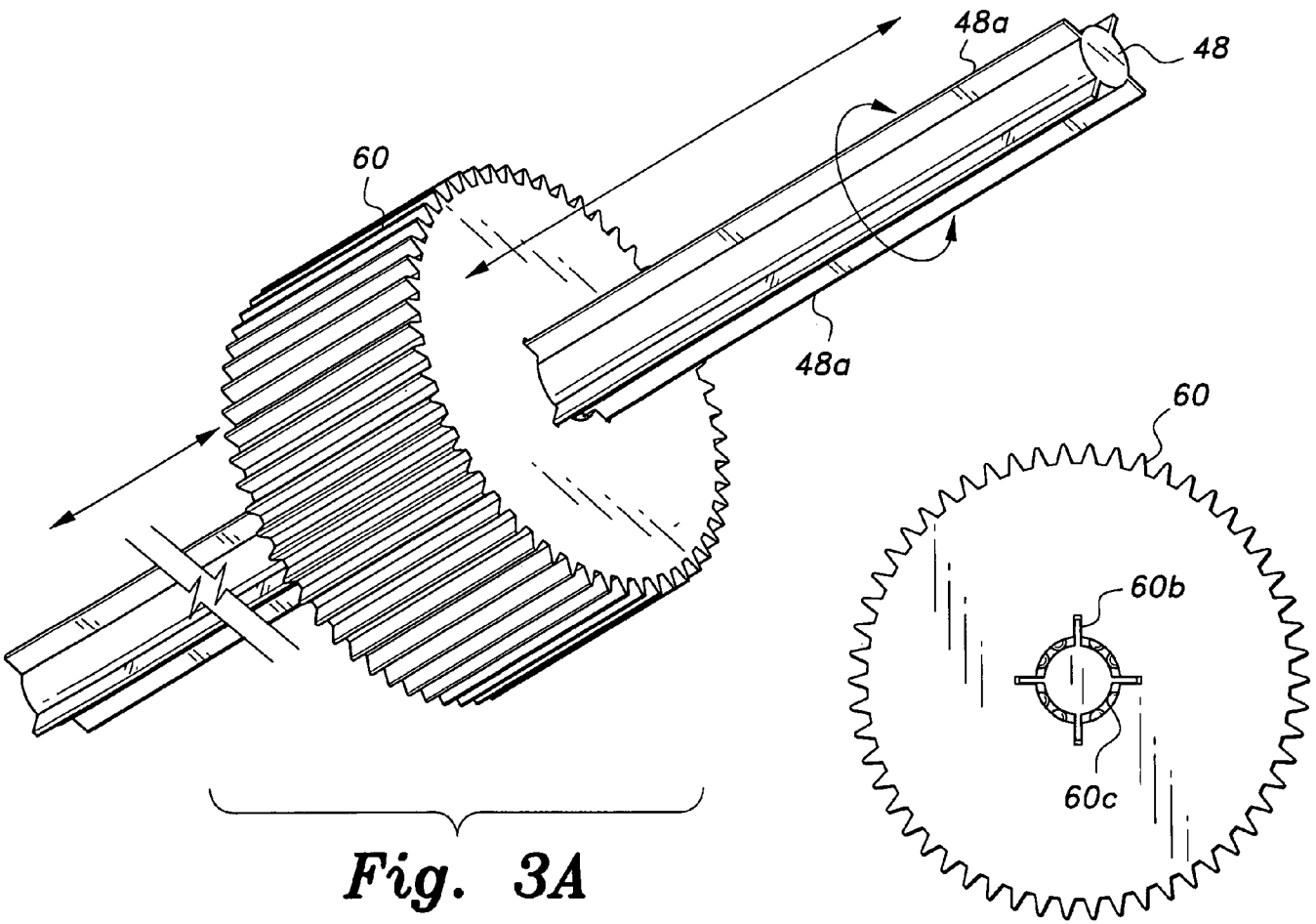
FIG. 3A is a partial, perspective view showing a sprocket mounted on a guide rod according to the present invention.
FIG. 3B is a front view of FIG. 3A according to the present invention.
Figure 4A:
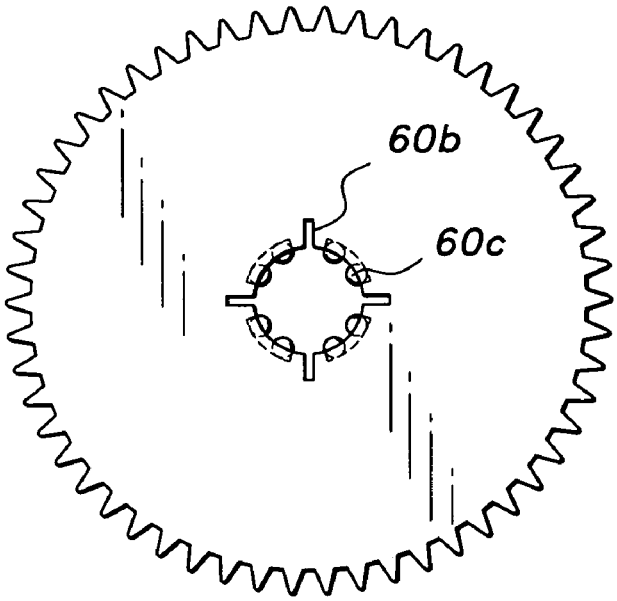
FIG. 4A is a front view of a sprocket according to the present invention.
Figure 4B:
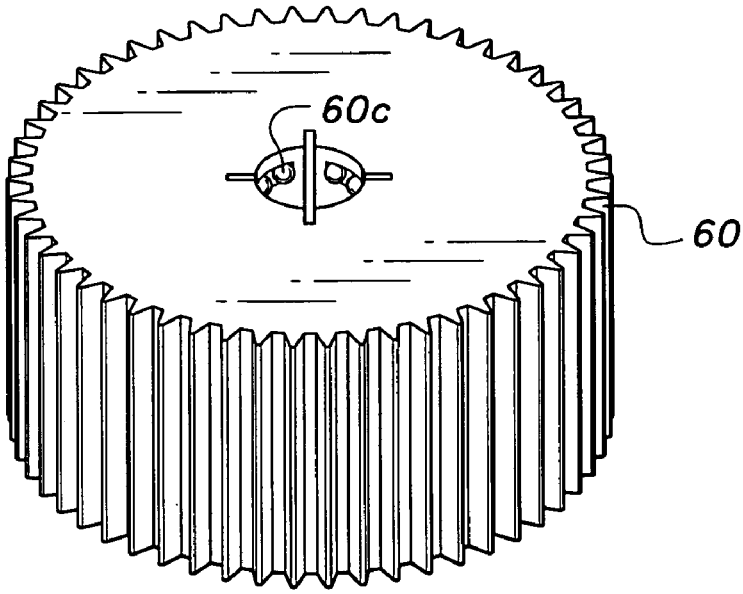
FIG. 4B is a perspective view of a sprocket according to the present invention.

Attention is now directed to FIG. 2A for a clearer understanding of the structure of second torque arm 34. An end block 40 defines the proximate end of arm 34. A first set of coaxially mounted pulleys 42 is disposed adjacent end block 40. Pulleys 42 are also coaxial with sprocket 30. A second set of coaxially mounted pulleys 44 is mounted adjacent distal end block 46. Four guide rods 48, 49 connect end block 40 to end block 46 by way of bearing assemblies 46*a* (not shown on block 40). A pair of pulley belts 50 is looped around the pulleys for movement thereon. Each belt 50 is provided with evenly spaced holes 50*a* therethrough. A mobile housing unit 52, having openings for receiving belts 50 and guide rods 48, 49 therethrough, is mounted for movement along a path defined by the belts, guide rods and torque arm 34. An array of pegs 54 (more clearly seen in FIGS. 2B-2H) is evenly spaced along each side of the torque arm.

As best seen in FIGS. 2B-2H, housing 52 is adapted to move along the torque arm by gravity in accordance to the inclination of the torque arm. Housing 52 encapsulates mechanisms that engage and disengage with the spaced holes 50*a* in belts 50. The mechanisms comprise upper and lower forks 56, 56*a* mounted on each side of the torque arm. The forks are vertically movable so that either the upper fork or the lower fork engages the holes in the belt. Forks 56, 56*a* are mounted on respective upper plates 58, which plates are each provided with a toothed surface. The surface is adapted to be engaged by teeth on upper sprockets 60. Sprockets 60 are mounted for rotating movement with guide rods 48. Separator plates 58*a* are movably engaged with spring biased lock pieces 62. Each lock piece 62 has teeth disposed on its upper end for engaging pegs 54. Plates 64 separate the upper and lower sprockets. Each separator plate has a toothed surface, which surface is engaged by lower sprockets 60*a*. Lower sprockets 60*a* are mounted for rotating movement with guide rods 49.

A more detailed view of the sprocket and guide rod arrangement is illustrated in FIGS. 3A-4B. Each guide rod 48, 49 has fins 48*a* thereon, which fins are spaced at ninety-degree intervals around the circumference of the guide rods. Each sprocket 60 is provided with slots 60*b* therethrough to receive fins 48*a*. An array of ball bearings 60*c* is positioned in the sprocket to insure smooth tracking for the sprocket on the guide rod.

Figure 5:
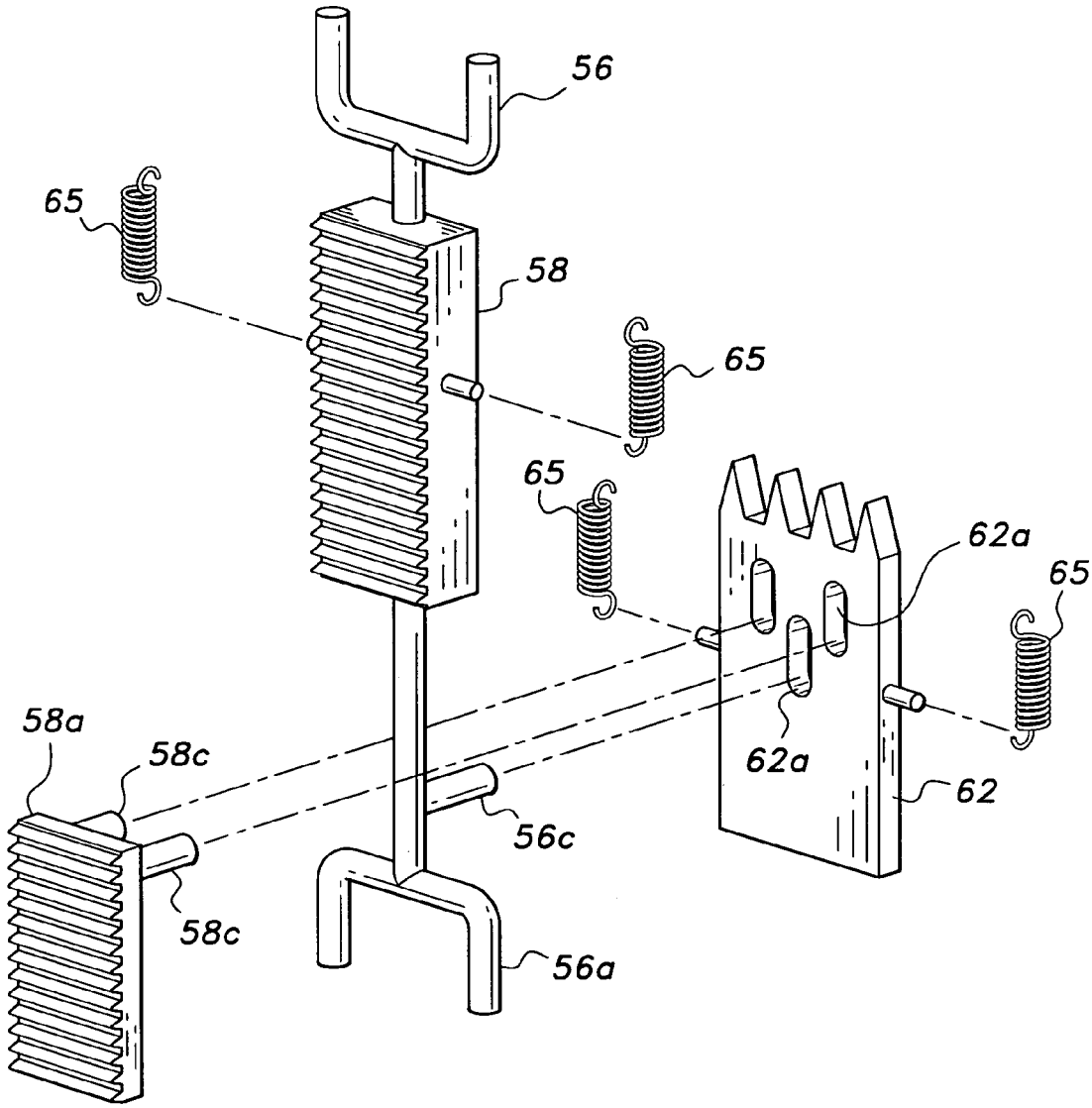
FIG. 5 is an exploded view of a fork and lock piece mechanism according to the present invention.

In FIG. 5, an exploded view shows the precise arrangement of the fork and lock piece mechanism. Each lock piece 62 is provided with apertures 62*a* therein for respectively receiving projections 58*c* disposed on the rear face of plate 58*a* and projection 56*c* disposed on the lower fork 56*a*. Projections 58*c* and 56*c* are removably received in apertures 62*a*. Springs 65 are provided to bias the lock piece and forks in a vertical direction.

Figure 6:
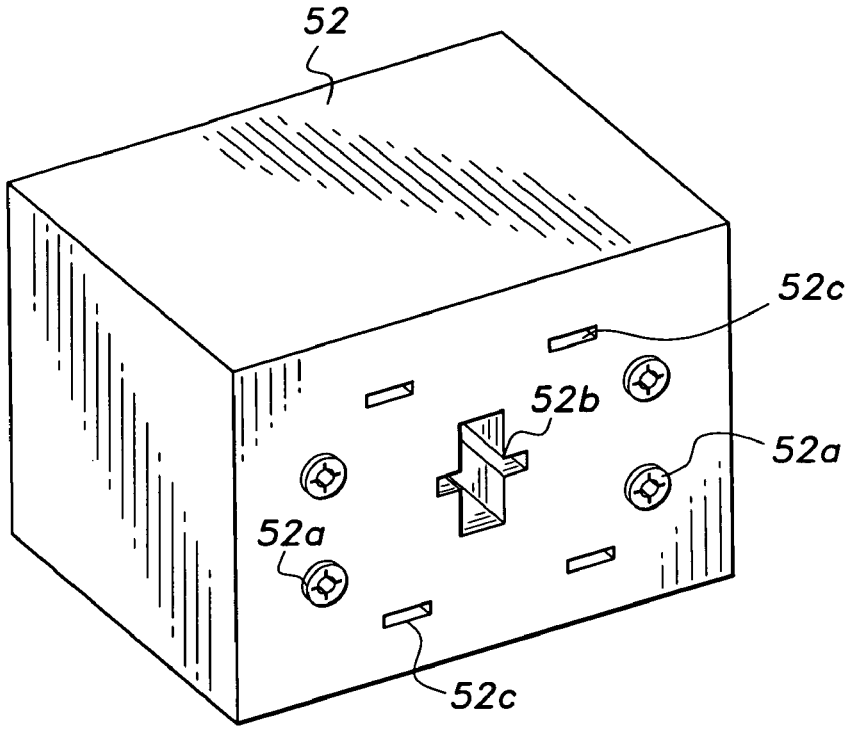
FIG. 6 is a perspective view of a mobile housing unit according to the present invention.
Figure 7A:
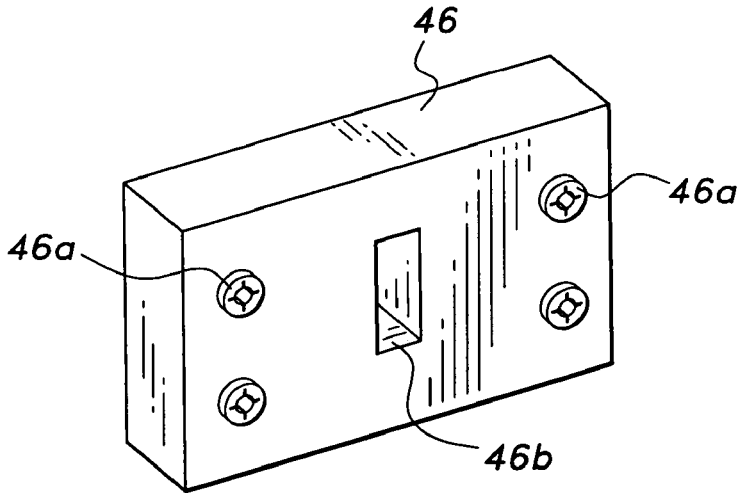
FIG. 7A is a perspective view of a first end block according to the present invention.

FIGS. 6 and 7A show detailed, perspective views of mobile housing 52 and end block 46. Mobile housing 52 is provided with bearing assemblies 52*a* for receiving guide rods 48 therethrough. Torque arm 34 and belts 50 are respectively received through opening 52*b* and slots 52*c*. End block 46 has an opening 46*b* therein to receive the end of torque arm 34.

Figure 7B:
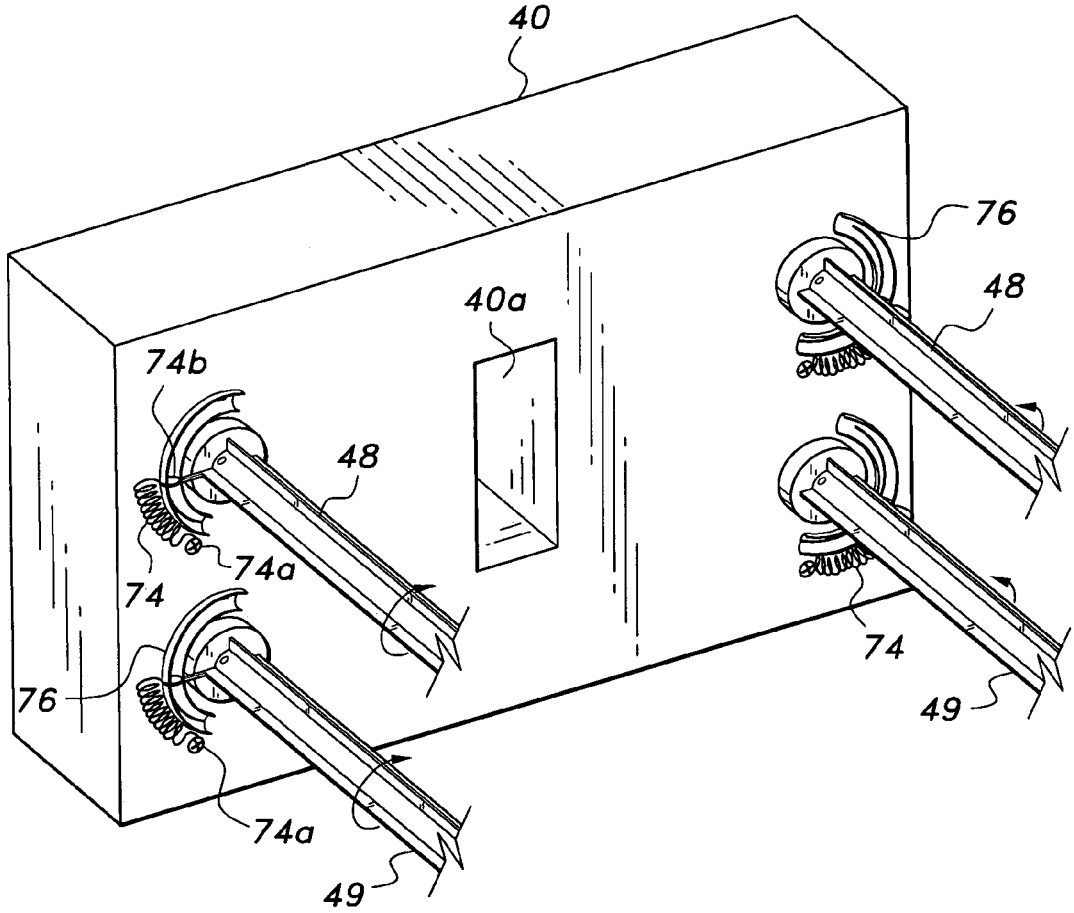
FIG. 7B is a perspective view of a second end block according to the present invention.
Figure 7C:
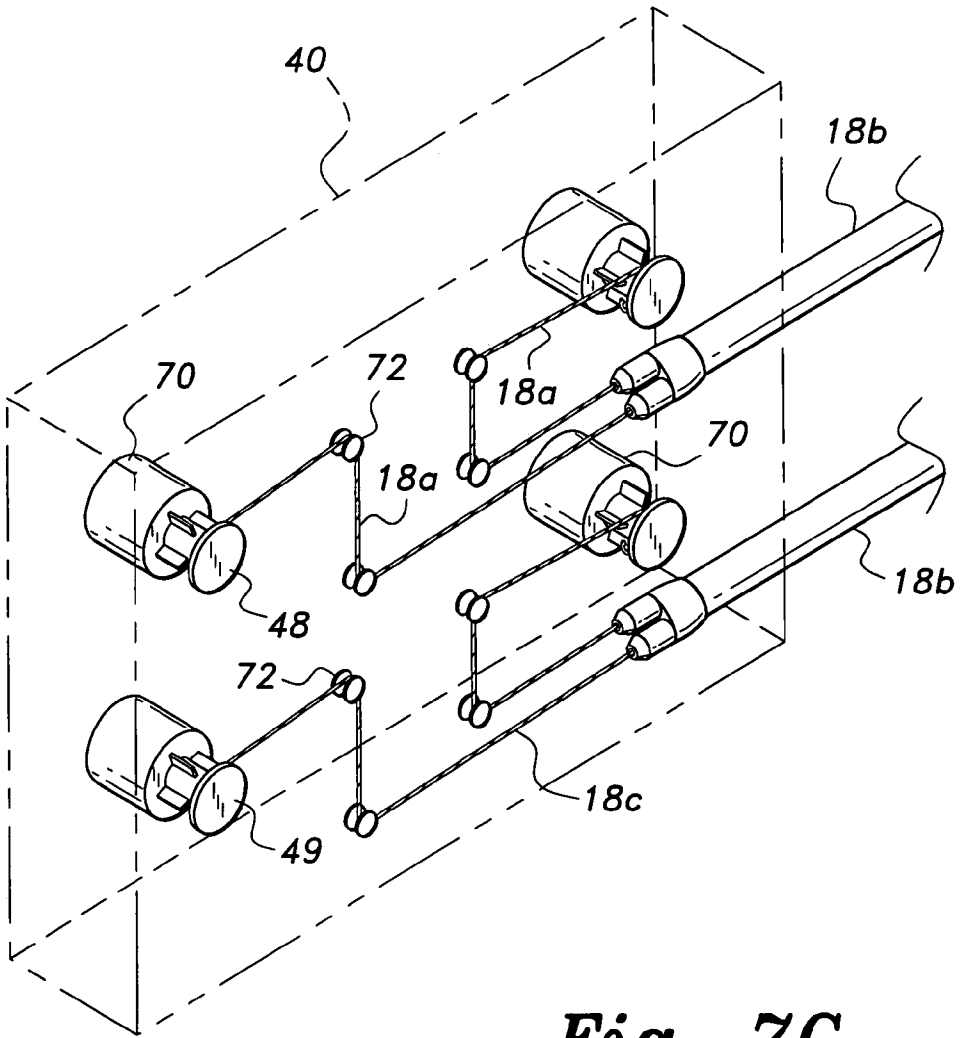
FIG. 7C is a cut-away, perspective view that shows the inside of a second end block according to the present invention.

As is illustrated in FIGS. 7B and 7C end block 40 encompasses plural bearing assemblies 70 therein. Each bearing assembly is adapted to receive a respective guide rod 48 at the top and 49 at the bottom. A series of pulleys 72 is positioned to support guide lines 18*a*, 18*c* thereon. Lines 18*a*, 18*c* extend through control line tubes 18*b* from control levers 18, 19 (FIG. 1). Each line 18*a*, 18*c* is attached to the end of a respective guide rod 48, 49. Respective spring members 74 each have a first end 74*a* attached to the outer surface of end block 40 and a second end 74*b* attached to a fin of a respective guide rod. A shield 76 interposes the space between spring 74 and guide rod 48, 49. An opening 40*a* receives the end of torque arm 34.

Figure 8:
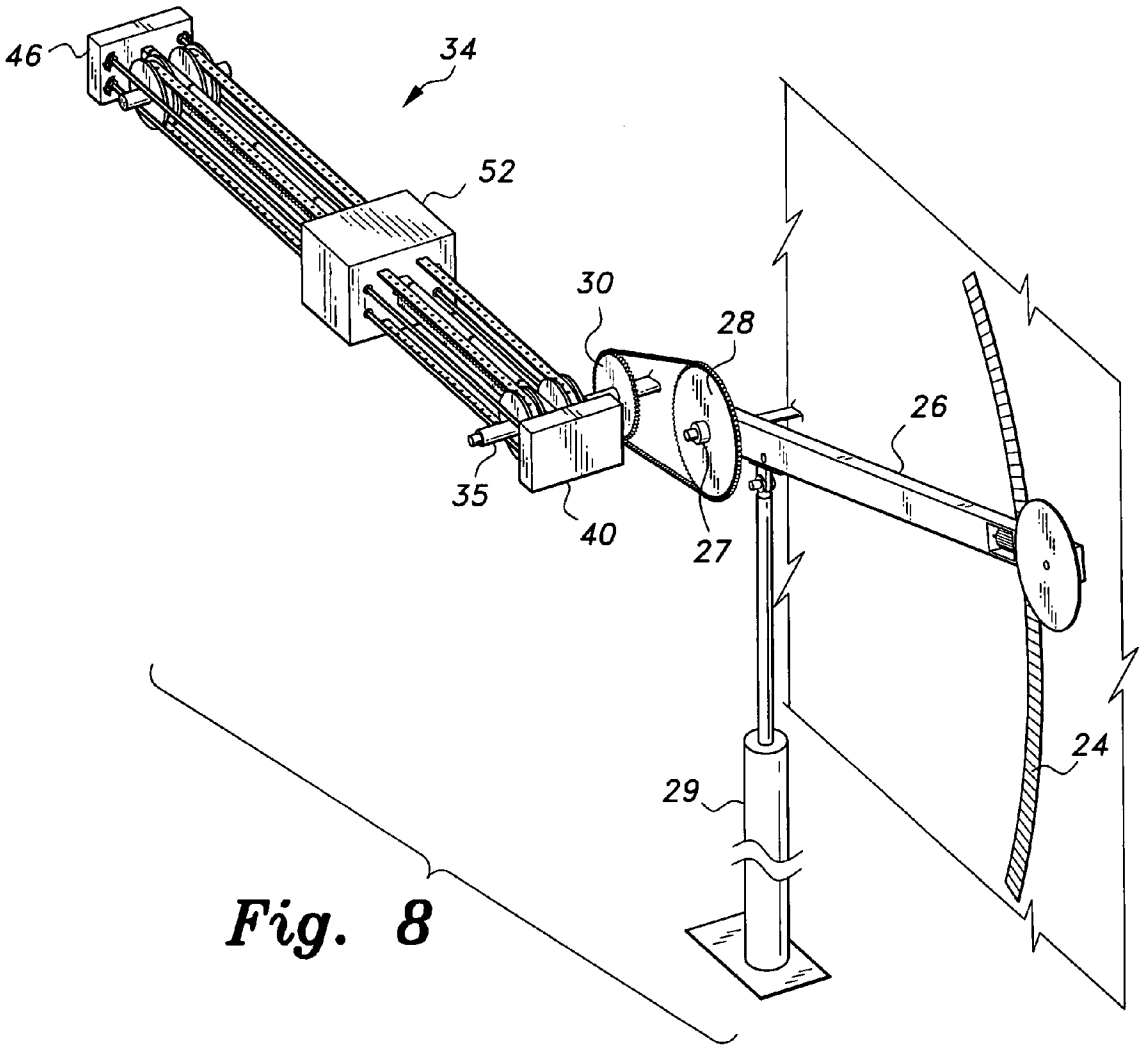
FIG. 8 is a partial, perspective view of the two torque arms according to the present invention.
Figure 9A:
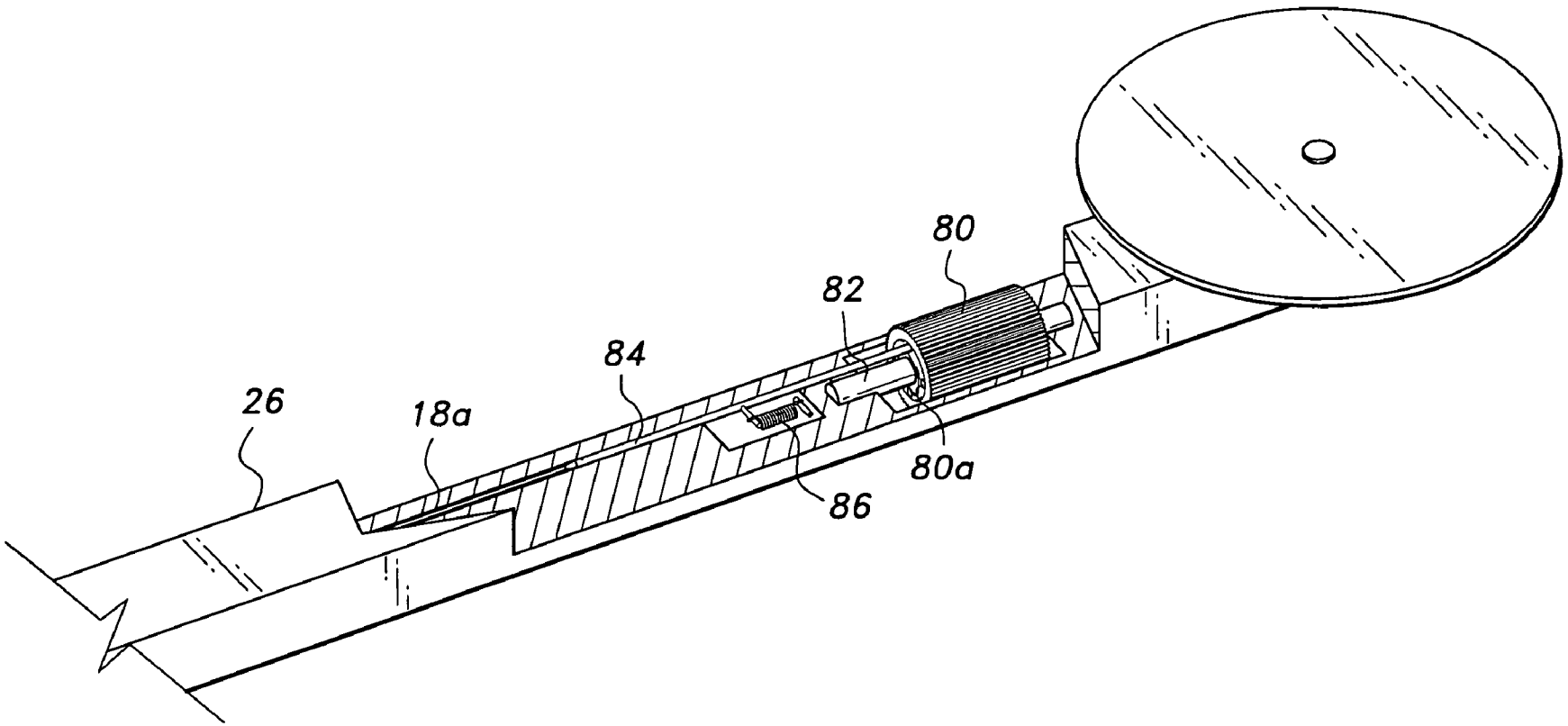
FIGS. 9A-9C are perspective, cutaway views of an exercise initiated torque arm according to the present invention.
Figure 9B:
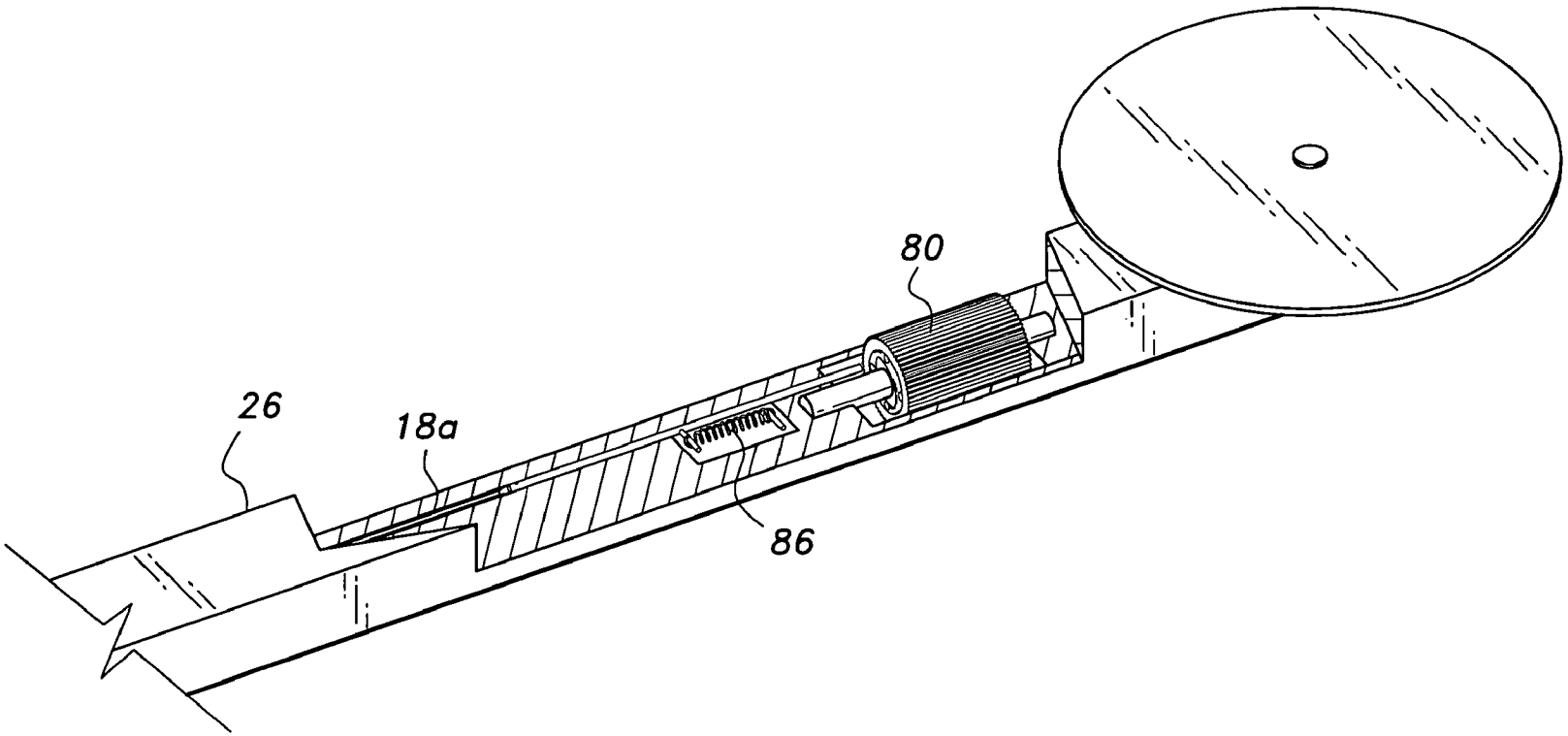
Figure 9C:
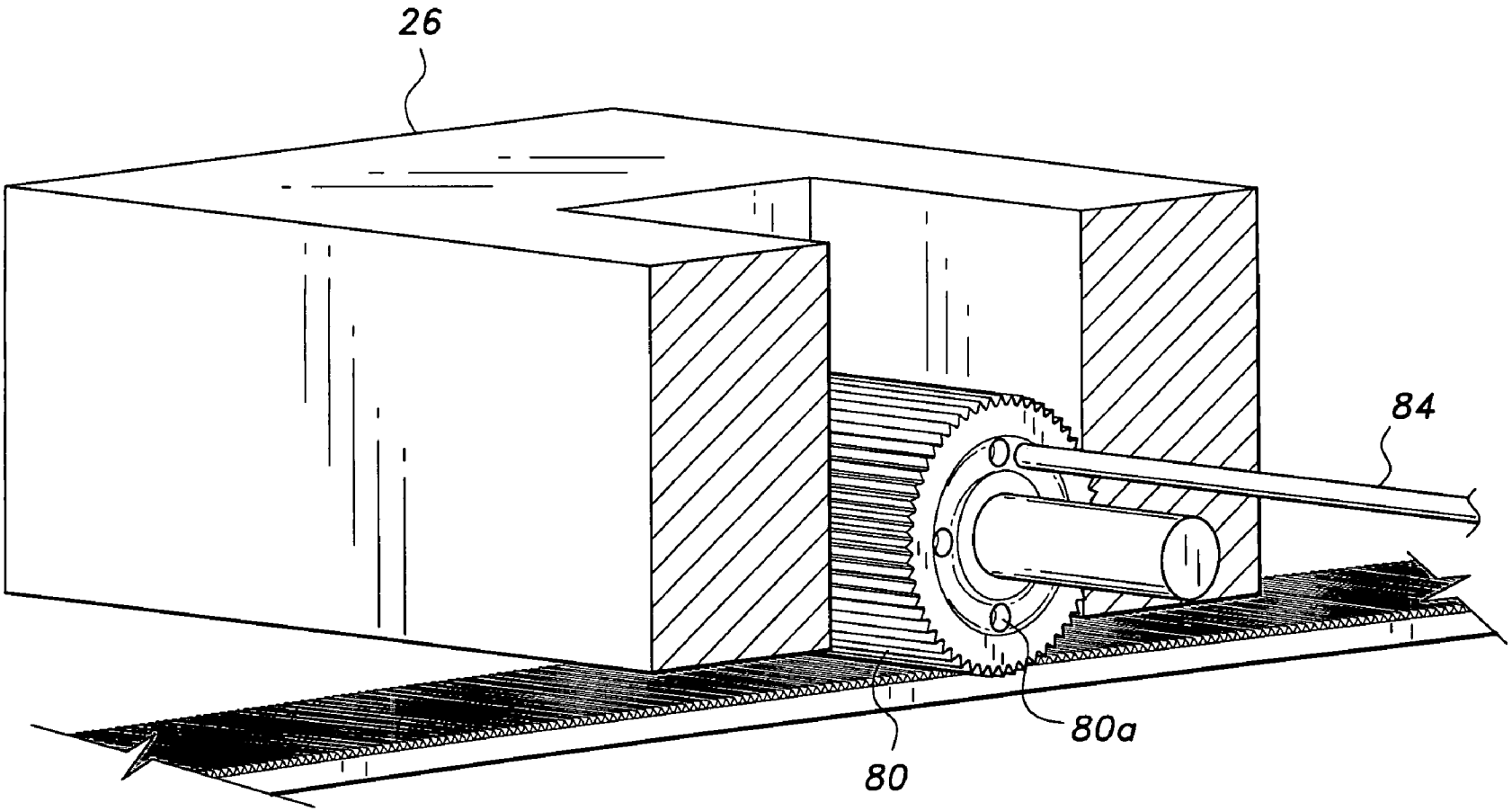

FIG. 8 shows in greater detail the inter action between torque arm 34 and torque arm 26. The two torque arms are rotatable on respective axles 35 and 27. As stated above, one end of torque arm 26 is adapted to move along gear track 24. Pneumatic device 29 enhances the raising and lowering function of arm 26. As best seen in FIGS. 9A-9C, torque arm 26 is provided with a gear 80 having apertures 80*a* therein. Gear 80 is rotated on axle 82. Lock pin 84 is disposed in a cavity defined in torque arm 26. A control line 18*a* is attached to lock pin 84 and functions to move the lock pin into and out of one of apertures 80*a*. A spring 86 biases the lock pin toward the apertures. FIG. 9A shows the lock pin in a locked position. FIGS. 9B and 9C show the pin in an unlocked position.

In operation, the control of resistance is determined by manipulating lever 18 or 19. If the user desires more resistance the positive lever 18 is squeezed. This action pulls the positive brake line 18*a* and causes the two top guide rods 48 to rotate. Rotation of guide rods 48 forces forks 56 downward to disengage from the top belts and causes forks 56*a* to engage the bottom belts. This movement also disengages the teeth of the lock pieces from the pegs on the torque arm. The mobile unit is now free to move in a direction to achieve more resistance.

To achieve less resistance, lever 19 is squeezed causing brake line 18*c* to rotate guide rods 49. This movement will force the lock pieces to disengage their teeth from the pegs on the torque arm.

It is to be understood that the present invention is not limited to the embodiment described above, but encompasses any and all embodiments within the scope of the following claims.

I claim:

1. A dynamically controlled resistance exercise machine, comprising:

a frame;

a torque arm, said torque mounted for pivotal movement and mechanically linked to said frame;

a mobile housing mounted for sliding movement on said torque arm;

first and second hand controlled levers for controlling the movement of said mobile housing on said torque arm;

first and second control lines extending from said first and second hand control levers; and an array of guide rods and pulley belts mounted on said torque arm, wherein said first and second control lines are attached to said guide rods.

2. The dynamically controlled resistance exercise machine as recited in claim 1, wherein said guide rods are mounted for rotational movement.

3. The dynamically controlled resistance exercise machine as recited in claim 1, including an array of sprockets mounted on said guide rods.

4. The dynamically controlled resistance exercise machine as recited in claim 1, including a plurality of pegs mounted on said torque arm.

5. The dynamically controlled resistance exercise machine as recited in claim 1, further including an auxiliary torque arm, said auxiliary torque arm being mounted at one end for pivotal movement and including means for linking it to said torque arm, said auxiliary torque arm further including means for mechanically linking the second end to said frame, said auxiliary torque arm further being further linked to said first and second hand controlled levers for controlling the movement of said auxiliary torque arm, whereby movement of said auxiliary torque arm interacts with said torque arm and said mobile housing.

6. A dynamically controlled resistance exercise machine, comprising:

a frame;

a first torque arm, said first torque arm mounted for pivotal movement and mechanically linked to said frame;

a second torque arm, said second torque arm pivotally mounted to said first torque arm;

a mobile housing mounted for sliding movement on said second torque arm;

first and second hand controlled levers for controlling the movement of said mobile housing on said torque arm;

first and second control lines extending from said first and second hand control levers; and an array of guide rods and pulley belts mounted on said second torque arm, wherein said first and second control lines are attached to said guide rods.

7. The dynamically controlled resistance exercise machine as recited in 6, wherein said guide rods are mounted for rotational movement.

8. A dynamically controlled resistance exercise machine as recited in claim 7, including an array of sprockets mounted on said guide rods.

9. A dynamically controlled resistance exercise machine as recited in claim 6, including a plurality of pegs mounted on said second torque arm.

10. The dynamically controlled resistance exercise machine as recited in claim 6, wherein said first torque arm is mounted at one end for pivotal movement and including means for linking it to said second torque arm, said first torque arm further including means for mechanically linking the second end to said frame, said first torque arm being further linked to said first and second hand controlled levers for controlling the movement of said first torque arm, whereby movement of said first torque arm interacts with said second torque arm and said mobile housing.

11. A dynamically controlled resistance exercise machine, comprising:

a frame;

a bench mounted on said frame a first torque arm, said first torque arm mounted for pivotal movement and mechanically linked to said frame;

a second torque arm, said second torque arm pivotally mounted to said first torque arm;

a mobile housing mounted for sliding movement on said second torque arm;

first and second hand controlled levers mounted on said bench for controlling the movement of said mobile housing on said second torque arm:

first and second control lines extending from said first and second hand control levers; and an array of guide rods and pulley belts mounted on said second torque arm, wherein said first and second control lines are attached to said guide rods.

12. The dynamically controlled resistance exercise machine as recited in claim 11, wherein said guide rods are mounted for rotational movement.

13. A dynamically controlled resistance exercise machine as recited in claim 11, including an array of sprockets mounted on said guide rods.

14. A dynamically controlled resistance exercise machine as recited in claim 11, including a plurality of pegs mounted on said second torque arm.

15. The dynamically controlled resistance exercise machine as recited in claim 11, wherein said first torque arm is mounted at one end for said pivotal movement and including means for linking it to said second torque arm, said first torque arm further including means for mechanically linking the second end to said frame, said first torque arm being further linked to said first and second hand controlled levers for controlling the movement of said first torque arm, whereby movement of said first torque arm interacts with said second torque arm and said mobile housing.

* * * * *